US005921195A

United States Patent [19]

Yilmaz

[11] Patent Number: 5,921,195

[45] Date of Patent: Jul. 13, 1999

[54] APPARATUS FOR COASTAL NAVIGATION AND SELF RESCUE

[76] Inventor: G. George Yilmaz, 28202 Meadowlark La., Bonita Springs, Fla. 34134

[21] Appl. No.: 08/969,934

[22] Filed: Nov. 28, 1997

[51] Int. Cl.[6] ..... B63C 1/02

[52] U.S. Cl. ..... 114/48; 114/61

[58] Field of Search ..... 114/44–53, 61, 114/123, 125, 258, 259, 260, 271

[56] References Cited

U.S. PATENT DOCUMENTS 5,115,753 5/1992 Craddock ..... 114/48

FOREIGN PATENT DOCUMENTS 256373 2/1913 Germany ..... 114/45

*Primary Examiner*—Jesus D. Sotelo

[57] ABSTRACT

The present invention provides adjustable vessel draft by controlling buoyancy and making navigation possible in both shallow and deep waters without changing the total vessel weight or its given payload. The present invention also provides necessary deep water seakeeping characteristics and dynamic stability of the vessel by using elastic secondary main hull or adjustable vertical hulls for safe operations and navigation in both shallow and deep waters for all purposes. The present invention also provides a vessel self rescue system which can also be used as a temporary apparatus of navigation in shallow waters.

6 Claims, 4 Drawing Sheets

APPARATUS FOR COASTAL NAVIGATION AND SELF RESCUE

FIELD OF THE INVENTION

The present invention lies in the field of naval architecture and ocean engineering and more particularly to coastal navigation and self rescue of a vessel.

BACKGROUND OF THE INVENTION

There is a need for a vessel which can be navigated on coastal shallow waters and when needed said vessel can rescue itself. For instance, the water depth of most estuarine and bay waters connected to deep waters range from two to five feet such as the Gulf of Mexico area. These estuarine and bay water bodies are well protected from waves and provide natural safe harbors. However, said water bodies cannot be used by most deep water vessels due to their deep draft. The present invention provides adjustable vessel draft making navigation possible in both shallow and deep waters without changing the total vessel weight or its given payload. The buoyancy and corresponding draft of the vessel is controlled by using adjustable vertical hulls or elastic secondary hull for safe operations and navigation in both shallow and deep waters for all purposes including seakeeping characteristics and dynamic stability. The present invention provides a vessel self rescue system which can also be used as a temporary means of navigation in shallow waters as needed. Prior art reviewed showed limited improvements to navigational capabilities of vessels of which examples are summarized below although they may be considered to be remote prior art.

U.S. Pat. No. 4,994,238 discloses a semi-submerged ship which has twin parallel sub-merged lower hulls spaced apart at least two hull widths with different fixed configurations.

U.S. Pat. No. 4,044,703 discloses a sailboat control apparatus which carries a pair of weighted complementary shaped keels for independent rotation about a common axis.

U.S. Pat. No. 2,850,747 discloses an amphibious catamaran which is also adapted for land travel with a fixed buoyancy configuration in water showing a combination of a catamaran and trailer in one.

SUMMARY OF THE INVENTION

Present invention controls both the buoyancy and the draft of a vessel without changing the vessel's weight, thus permitting safe navigation of the vessel in both deep and very shallow waters. Present invention also provides a self rescue system which can be used as a temporary means of navigation in shallow waters. The vessel consists of at least two vertical hulls and a main hull which houses the controls for operating the vessel and includes accommodations for passengers and cargo. In deep water the bottom of the main hull lies above the surface of the water and the main hull is supported by said adjustable vertical hulls preferably connected to the opposite sides of the main hull. Said main hull and vertical hulls can be designed in any shape to function as floating hulls or semi-submerged hulls or submerged hulls as desired.

The two elongated vertical hulls in any shape are connected to the main hull by linear or radial connectors which allow the vertical hulls to move up and down as desired. When the vessel is operated in deep water, adjustable vertical hulls are moved down into water till the main hull is above the water surface to provide dynamic stability and better seakeeping characteristics of the vessel. As the vessel is being moved into shallow waters, the vertical hulls are moved up relative to the main hull as desired to a position that the main hull carries most if not all of the vessel's buoyancy and associated draft. Therefore, the draft of the vessel is markedly reduced to permit the vessel to operate in shallow water and thus have the ability to board and discharge its cargo or take on cargo directly from coastal waters of a beach. Furthermore, present invention provides the vessel with the ability to self rescue itself using the adjustable vertical hulls or an elastic secondary hull. The elastic secondary hull is connected to the main hull and expanded or contracted as needed to occupy the space between vertical hulls and the main hull by mechanical or physical means.

DETAILED DESCRIPTION OF THE PREFERRED EMBODIMENTS

Figure 1:
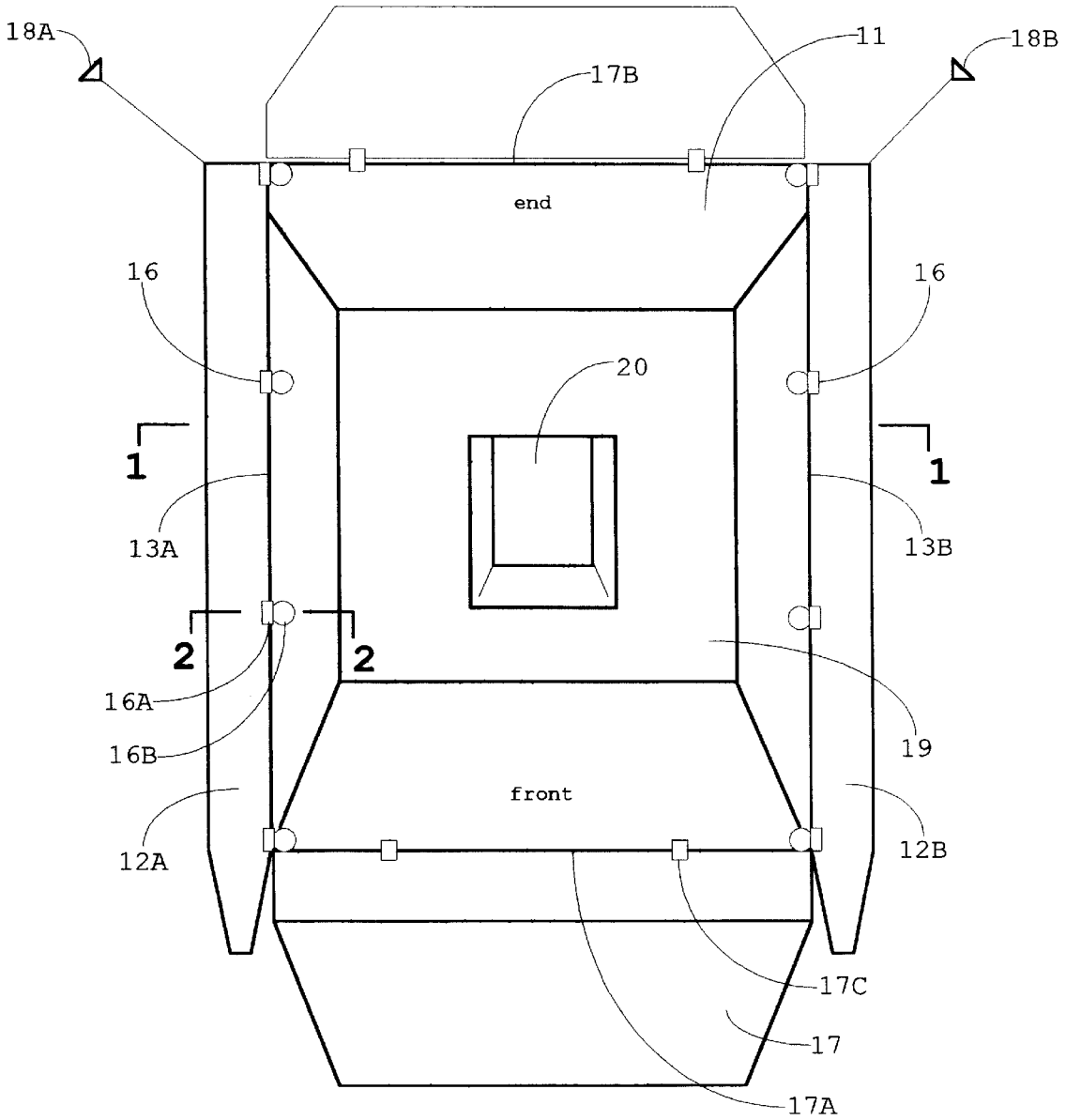
FIG. 1 is a plan view showing the general concept and visible elements of present invention.
Figure 1A:
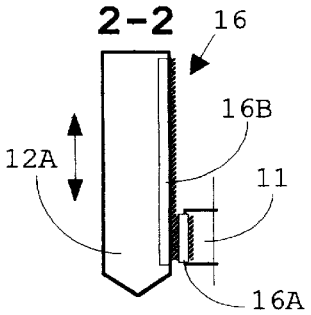
FIG. 1A is a view of cross section 2—2 of FIG. 1 showing a radial connector including main hull connector and vertical hull connector.

FIG. 1 is a plan view of a vessel showing the general concept and visible elements of my invention including a main hull 11 and vertical hulls 12A and 12B which are connected to main hull 11 by linear or radial connectors 16 along the axis 13A and 13B respectively. An example of said connector 16 which includes main hull connector 16A and vertical hull connectors 16B is shown in section view 2—2 of FIG. 1. FIG. 1. also shows main hull 11 having a front and rear end sections, superstructure 19 and 20, surface extensions 17, and anchors 18A and 18B which are to stabilize or control the vessel during boarding or self rescue in shallow water conditions. The hull extensions 17 are rotated along the axis 17A or 17B using rotational connectors 17C to demonstrate boarding or unloading surface area in very shallow waters. Said main hull 11 and vertical hulls 12A and 12B can be designed in any shape to function as floating hulls or semi-submerged hulls or submerged hulls as desired.

Figure 2:
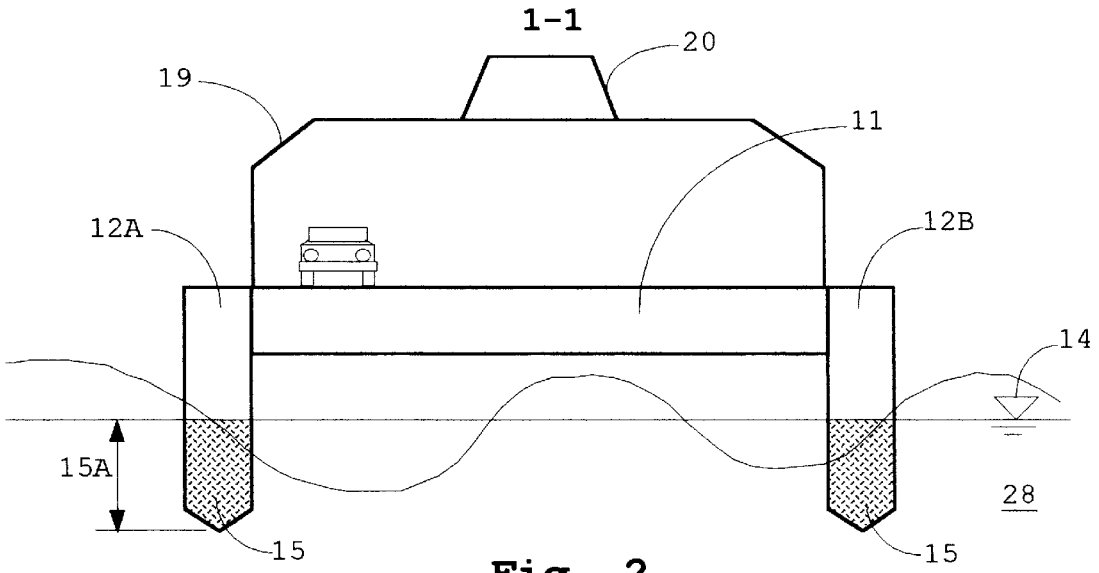
FIG. 2 is a section view along line 1—1 of FIG. 1 showing main hull and vertical hulls positioned in deep water condition.

FIG. 2 is a section view along line 1—1 of FIG. 1 and shows the main hull 11 and vertical hulls 12A and 12B in deep water conditions 28. The vertical hulls 12A and 12B are positioned below the water surface 14 to the level that the main hull 11 of the vessel is above the water surface 14. The vertical hulls are connected to main hull 11 along the axis 13A and 13B respectively using pairs of linear or radial connectors 16 which allow said vertical hulls to move upward or downward relative to the main hull 11. Buoyancy of the vessel 15 and draft 15A in deep water condition 28 is shown in FIG. 2.

Figure 3:
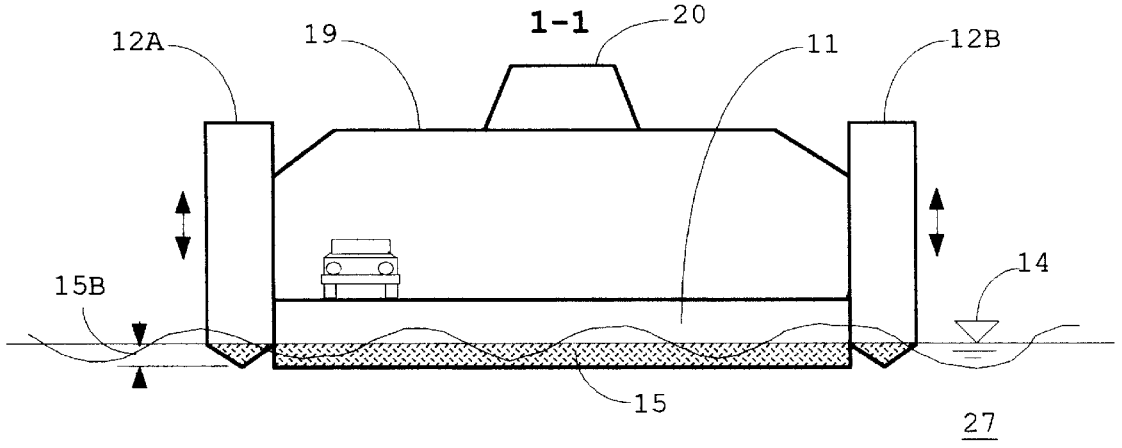
FIG. 3 is a section view along line 1—1 of FIG. 1 showing main hull and vertical hulls positioned in shallow water condition.

FIG. 3 is a section view along line 1—1 of FIG. 1 and shows the vessel's buoyancy 15 and corresponding draft 15B when hulls 12A and 12B are positioned for navigation in shallow water 27. Accordingly, when hulls 12A and 12B are positioned for navigation in deep waters, total buoyancy 15 corresponds to a total draft 15A as mentioned before. Since the buoyancy would be a constant for a given payload, draft 15A and 15B would be a function of positions and shape of the vertical hulls and the main hull allowing the vessel to navigate in both deep and shallow waters as shown in FIG. 2 and FIG. 3. Said draft 15B is achieved by moving vertical hulls 12A and 12B upward relative to main hull 11 to a desired position till said main hull 11 floats on water and is partially under water level 14. The vessel's buoyancy mostly corresponds to displacement created by portion of said main hull 11 under water level 14.

Figure 4:
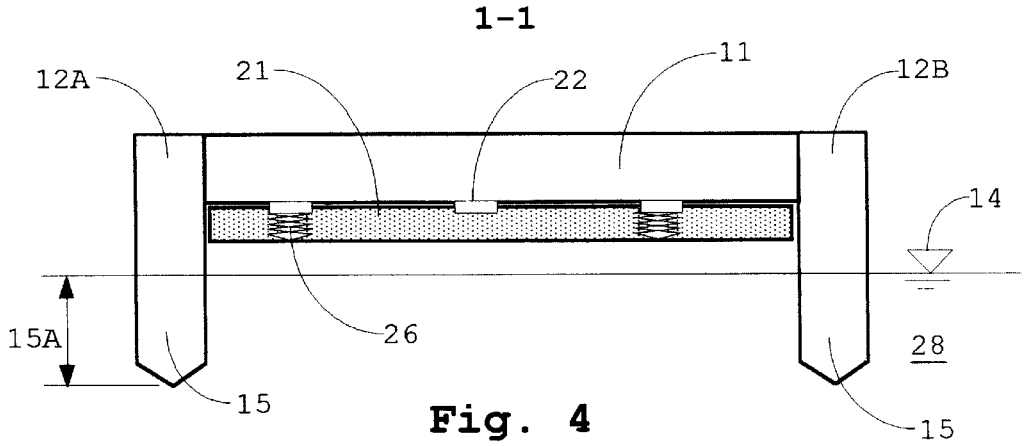
FIG. 4 is a section view along line 1—1 of FIG. 1 showing elastic secondary main hull in representative deep water condition.

FIG. 4 shows a section view along line 1—1 of FIG. 1 including fixed or adjustable vertical hulls such as 12A and 12B, and elastic secondary main hull 21 connected to main hull 11 using secondary hull connectors 22. Elastic secondary main hull 21 is positioned by mechanical or physical means in representative deep water conditions 28 allowing the vessel to navigate and operate with desired seakeeping characteristics as a multi hull vessel as shown in FIG. 4.

Figure 5:
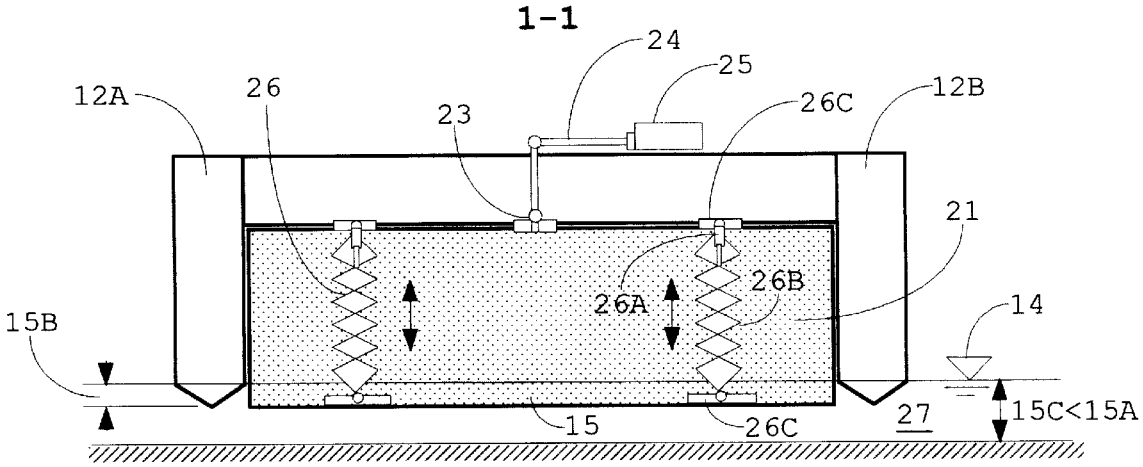
FIG. 5 is a section view along line 1—1 of FIG. 1 showing elastic secondary main hull being used for coastal navigation or as a self rescue system in representative shallow water condition.

FIG. 5 shows a section view along line 1—1 of FIG. 1 including demonstration of coastal navigation and self rescue system consisting of adjustable vertical hulls such as 12A and 12B and elastic secondary main hull 21. Said elastic secondary main hull is contracted or expanded by mechanical or physical means such as using a mechanical device 26 or a fluid control system respectively. Said mechanical device consist of a power source such as controlled fluid pump or gear box 26A connected to the vessel using mechanical connector 26C, and a mechanical arm such as an extension bar unit 26B. Mechanical connectors 26C also connect 26B to elastic secondary hull 21. Said fluid control system consist of fluid pressure and flow control valve 23, fluid pressure and flow transmission line 24, and fluid pressure control pump 25. Expanded elastic secondary main hull 21 allows the vessel to navigate in coastal and very shallow waters 27 as if the vessel is a single hull vessel with desired draft conditions 15B where water depth is 15C which is shown less than 15A in FIG. 5. Elastic secondary main hull 21 can also be used as a self rescue system where the vessel would be grounded at draft 15A where water depth is 15C but not grounded at draft 15B as shown in FIG. 4 and FIG. 5 respectively. Said self rescue system is for a vessel which consists of a main hull 11 and more than one fixed or adjustable vertical hulls such as 12A and 12B. Elastic secondary main hull 21 is connected to main hull 11 of said vessel and occupies the space between said main hull 11 and fixed or adjustable vertical hulls such as 12A and 12B as desired. A preferred fluid control system consists of one or more fluid pressure and flow control valve 23 which are connected to elastic secondary main hull 21. Fluid pressure and flow control valve 23 is connected to at least one fluid pressure control pump 25 which is connected to said vessel. Fluid pressure and flow transmission line 24 connect said fluid pressure and flow control valve 23 to said fluid pressure control pump 25. The fluid control system allows elastic secondary main hull 21 to be expanded or contracted as needed. Said elastic secondary hull can also be semi-elastic and adjusted by mechanical or physical means as desired.

Figure 6:
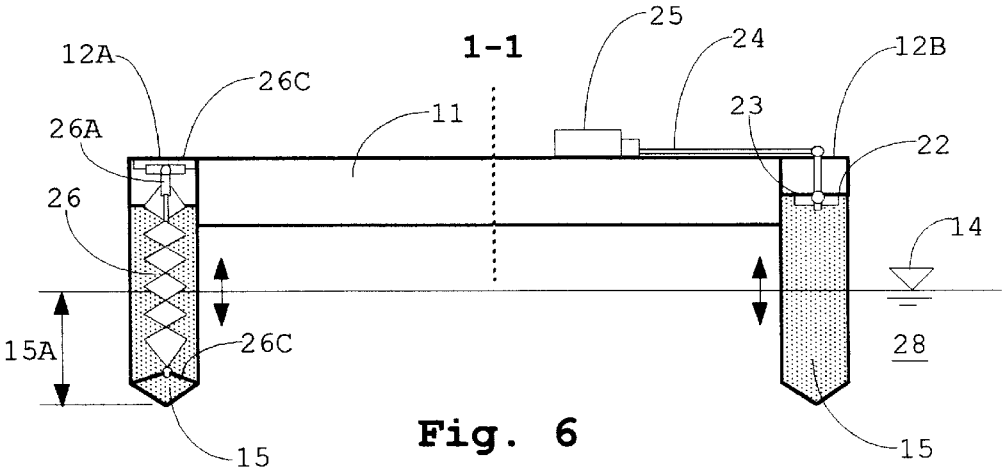
FIG. 6 is a section view along line 1—1 of FIG. 1 showing elastic vertical hulls positioned in representative deep water condition.
Figure 7:
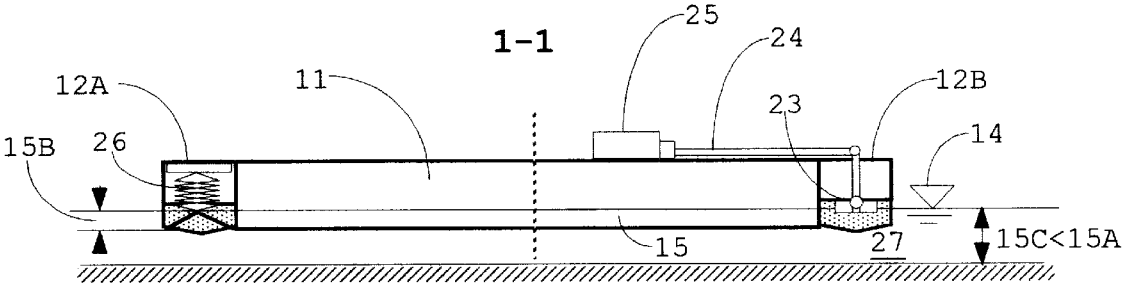
FIG. 7 is a section view along line 1—1 of FIG. 1 showing elastic vertical hulls being used for coastal navigation or as a self rescue system in representative shallow water condition.

Vertical hulls 12A and 12B can be rigid, semi-elastic, or elastic and can be adjusted by mechanical or physical means as shown in FIG. 6 and FIG. 7. FIG. 6 shows elastic vertical hulls shown as 16A and 16B positioned for deep water condition 28 by same or similar mechanical or physical means described for elastic secondary main hull 21 including a mechanical device 26 or a fluid control system which consist of fluid pressure and flow control valve 23, fluid pressure and flow transmission line 24, and fluid pressure control pump 25. FIG. 7 shows elastic vertical hulls shown as 16A and 16B positioned for shallow water condition 27 by said mechanical or physical means both of which allow said vertical hulls to contract or expand as desired. Said mechanical device and said fluid control system are shown on left and right side of both FIG. 6 and FIG. 7 respectively.

While I have fully shown and described embodiments of my apparatus for coastal navigation and self rescue, no limitations as to the scope of the present invention should be implied from the foregoing description. The true scope of the present invention is limited only by the following claims.

I claim:

1. A vessel designed for operation in deep water which can be navigated boarded and unloaded in very shallow water and has ability to rescue the vessel itself comprising a main hull, two similar elongated vertical hulls, each of said vertical hulls being connected on opposite sides of said main hull by mechanically powered connectors which allow each vertical hull to move upward and downward relative to said main hull, and anchors connected to said vessel for securely positioning the vessel.

2. A coastal navigation and self rescue system for a vessel designed for operation in deep water and said vessel has a main hull and two adjustable vertical hulls connected on opposite sides of said main hull comprising an elastic secondary main hull lying beneath said main hull of said vessel operable by mechanical and physical means to fill the space between said main hull and vertical hulls of said vessel, and secondary main hull connectors to connect said elastic secondary main hull to said main hull.

3. Apparatus as said forth in claim 2 which includes a fluid control system which allows elastic secondary hull to expand or contract comprising fluid pressure and flow control valves which are connected to said elastic secondary main hull, at least one fluid pressure control pump which is connected to said vessel, and fluid pressure and flow transmission lines which connect said fluid pressure and flow control valves to said fluid pressure control pump.

4. Apparatus as said forth in claim 2 which includes a mechanical device which allows elastic secondary hull to expand or contract comprising a power source, a mechanical arm which is powered by said power source, a mechanical connector which connects said mechanical arm to said elastic secondary hull.

5. Apparatus as said forth in claim 2 which includes adjustable vertical hulls which are elastic and can be adjusted by mechanical and physical means using a mechanical device or fluid control system respectively.

6. A coastal navigation and self rescue system for a vessel designed for operation in deep water and said vessel has a main hull and two vertical hulls connected on opposite sides of said main hull comprising an elastic secondary main hull lying beneath said main hull of said vessel operable by mechanical and physical means to expand and to fill the space between said main hull and fixed vertical hulls of said vessel during coastal navigation and self rescue, and secondary main hull connectors to connect said elastic secondary main hull to said main hull.

* * * * *